United States Patent [19]

Behr et al.

[11] Patent Number: 4,922,065

[45] Date of Patent: May 1, 1990

[54] TEMPERATURE-COMPENSATING ACCELEROMETER

[75] Inventors: Leonard W. Behr, Pontiac; Robert B. Colten, Bloomfield Hills; Donald A. Duda, Novi, all of Mich.

[73] Assignee: Automotive System Laboratory, Inc., Farmington Hills, Mich.

[21] Appl. No.: 320,974

[22] Filed: Mar. 9, 1989

[51] Int. Cl.[5] ..... H01H 35/14; H01F 3/00

[52] U.S. Cl. ..... 200/61.45 M; 200/61.53; 335/257

[58] Field of Search ..... 200/61.45 R, 61.45 M, 200/61.53; 335/256, 257, 258, 266; 337/393, 396, 400, 1, 2, 3, 12, 13

[56] References Cited

U.S. PATENT DOCUMENTS

| | | | |
|---|---|---|---|
| 3,832,505 | 8/1974 | Wong | 335/257 X |
| 4,093,836 | 6/1978 | Ewy et al. | 335/256 X |
| 4,329,549 | 5/1982 | Breed | 200/61.53 X |
| 4,827,091 | 5/1989 | Behr | 200/61.53 X |

*Primary Examiner*—J. R. Scott

*Attorney, Agent, or Firm*—Lyman R. Lyon

[57] ABSTRACT

An acceleration sensor comprises a tube formed of an electrically-conductive non-magnetic material; a stop defining an end of the tube which moves longitudinally thereof in response to temperature; a magnetically-permeable element, such as a iron washer, proximate with the end of the tube; and a sensing mass in the tube comprising a pair of permanent magnets secured to the opposite sides of an iron spacer so as to place a pair of like magnetic poles thereof in opposition. In operation, the sensing mass interacts with the iron washer so as to be magnetically biased against the stop, while the stop moves longitudinally of the tube to maintain a nearly constant threshold magnetic bias on the sensing mass irrespective of variations in sensor temperature. The sensing mass is displaced in response to acceleration of the housing from its first position against the stop towards a second position in the tube when such acceleration overcomes the magnetic bias, while the tube itself interacts with the sensing mass to provide magnetic damping therefor. Upon reaching the second position in the tube, the sensing mass bridges a pair of electrical contacts with an electrically-conductive surface thereof to indicate that a threshold level of acceleration has been achieved. An electrical coil is secured proximate with the iron washer which, when energized, reversibly magnetizes the latter, whereby the sensing mass is either repelled to the second position in the tube or more strongly biased against the stop.

16 Claims, 1 Drawing Sheet

TEMPERATURE-COMPENSATING ACCELEROMETER

BACKGROUND OF THE INVENTION

The instant invention relates to means for sensing the acceleration profile of an object, such as a motor vehicle.

The prior art teaches magnetically-biased acceleration sensors, or accelerometers, comprising a housing having an inertial or sensing mass within a cylindrical passage therein which is magnetically biased towards a first end of the passage. Such magnetic biasing of the sensing mass offers the advantage of providing a maximum biasing force on the sensing mass when the sensing mass is in its initial position proximate the first end of the passage. When the housing is subjected to an accelerating force which exceeds this threshold magnetic bias, the sensing mass moves along the passage away from the first end thereof toward a second position at the other end thereof, with such movement being retarded by suitable damping means therefor Where the acceleration input is of sufficient magnitude and duration to displace the sensing mass to the second position within the passage, the sensing mass triggers switch means in the sensor, as by bridging a pair of electrical contacts therein, whereupon an instrumentality connected with the switch means, such as a vehicle passenger restraint system, is actuated. In this manner, the sensor mechanically integrates the acceleration input to the housing.

An example of a magnetically-biased accelerometer is taught in U.S. Pat. No. 4,329,549, issued May 11, 1982 to Breed, wherein a magnet secured to the housing proximate the first end of the tubular passage exerts a magnetic biasing force on a magnetically-permeable ball, with the movement of the ball being damped by a gas contained within the tube. However, as the ball moves along the tube from its initial position at the first end thereof towards the contacts at the other end, the gas damping force quickly predominates in retarding the ball's movement. Thus, in the event of a loss of the damping effect due to the failure of the seal which operates to maintain the gas within the tube, any acceleration exceeding the initial magnetic biasing threshold will cause the ball to be fully displaced to the other end of the tube, thereby triggering the switch means of the sensor. In other words, an accelerometer constructed in accordance with Breed is not able to properly mechanically integrate acceleration inputs thereto in the absence of the gas damping. It is also significant that the use of gas damping requires extreme tolerance control of the gap between the walls of the tube and the ball, thereby increasing manufacturing costs.

Additionally, the ball-in-tube configuration taught by Breed may not properly integrate an acceleration input, the direction of which is not wholly coincident with the longitudinal axis of the tube: as the threshold magnetic bias is exceeded, the ball will begin to roll as it translates the length of the tube. The presence of any cross-axis vibration or transient acceleration may cause contact between the ball and other parts of the tube's inner surface such as the "roof" thereof, whereupon the ball's rotational momentum will try to direct the ball back towards the first end of the tube, even when the longitudinal component of the acceleration input is still urging the ball towards the contacts.

Still further, the magnetic bias and the gas damping featured in the Breed sensor are susceptible to unacceptable variation over temperature. Specifically, the magnetic flux generated by the fixed magnet is affected by changing temperature so as to produce significant variation in the threshold magnetic bias on the ball thereof. And, the disparate coefficients of thermal expansion of the ball and tube, as well as the changing compressibility of the damping gas over temperature, combine to adversely affect the damping characteristics of sensors constructed in accordance with the Breed patent.

Application Ser. No. 248 143, filed Sept. 23, 1988, now U.S. Pat. No. 4,827,091, teaches an acelerometer having a magnetic sensing mass which is magnetically biased against a magnetically-permeable element secured proximate with an end of a passage within a housing. When the housing is subjected to an acceleration sufficient to overcome the magnetic biasing force, the sensing mass is displaced towards the contacts at the other end of the passage, such displacement being damped by the magnetic interaction of the sensing mass with a plurality of electrically-conductive non-magnetic rings encompassing the passage. The contacts at the other end of the passage move longitudinally of the passage in response to temperature in order to compensate for the effects of temperature on the magnetic damping employed therein. The accelerometer further comprises a plurality of electrical coils encompassing the passage which, when energized by the delivery of direct current therethrough, effects the displacement of the sensing mass to the second position in the passage, against the contacts, whereby the operability of the sensor may be readily confirmed. Alternatively, the current is delivered through the coils in the reverse direction, whereby the magnetic biasing force is controllably increased.

Unfortunately, the accelerometer taught in U.S. Pat. No. 4,827,091, like the Breed sensor discussed hereinabove, is unable to compensate for the effects of temperature on the magnetic flux generated by the sensing mass and, hence, the sensor's threshold magnetic bias. Thus, as the magnetic flux generated by the sensing mass reversibly decreases with increasing temperature, the threshold magnetic bias is correspondingly decreased, with the attendant risk that the instrumentality controlled by the sensor will be triggered by a relatively low acceleration input.

Finally, it is noted that accelerometers are frequently deployed in pairs in the interest of increased reliability, e.g., a sensor having a relatively low acceleration threshold serves to "arm" a second sensor having a relatively high acceleration threshold tailored to the particular application involved However, in the event that the high-threshold sensor fails in the "closed" condition, i.e., incorrectly indicates an acceleration condition necessitating the deployment of the instrumentality controlled thereby, any acceleration exceeding the low acceleration threshold of the "arming" sensor will cause the deployment of that instrumentality. A graphic illustration of this condition is the deployment of an air bag upon encountering a pothole subsequent to the failure of the high-threshold sensor. It is therefore highly desirable to be able to spontaneously increase the biasing force on the sensing mass of the arming sensor and, hence, its acceleration threshold, upon an indication that the high-threshold sensor has "failed closed."

SUMMARY OF THE INVENTION

It is the object of the instant invention to provide a magnetically-biased accelerometer which employs magnetic damping to obviate the extreme manufacturing tolerances typical of prior art gas-damped accelerometers.

A further object of the instant invention is to provide an accelerometer which automatically compensates for the effects of temperature on both the magnetic biasing force and the magnetic damping force employed thereby.

A further object of the instant invention is to provide an accelerometer having means incorporated therein for testing its operability.

Yet another object of the instant invention is to provide a magnetically-biased accelerometer, the threshold biasing force of which may be readily increased upon the delivery of a direct current thereto.

The accelerometer of the instant invention comprises a housing having a tubular passage extending therein, one end of which is defined by a stop which moves longitudinally of the passage in response to changes in the operating temperature of the sensor: a magnetically-permeable element, such as an iron or steel washer, secured to the housing proximate with the end of the passage defined by the stop; and a magnetic sensing mass within the passage comprising a pair of cylindrical longitudinally-polarized permanent magnets and a magnetically-permeable spacer, the magnets being secured to opposite sides of the spacer so as to place a pair of like magnetic poles thereof in opposition. The thickness of the spacer is chosen so as to prevent the saturation thereof while maximizing the magnetic flux generated by the sensing mass.

The magnetic bias on the sensing mass towards the washer is such that the sensing mass remains in a first position against the stop until it is overcome by acceleration of the housing, whereupon the sensing mass is displaced longitudinally of the passage in response to such acceleration towards a second position therein. The sensing mass operates switch means upon reaching the second position within the passage, thereby indicating that a threshold level of acceleration has been achieved. In the preferred embodiment, for example, the switch means comprises a pair of electrical contacts which are bridged by an electrically-conductive surface of the sensing mass upon displacement of the sensing mass to the second position within the passage.

The instant accelerometer further comprises magnetic damping means for retarding the displacement of the sensing mass within the passage. In the preferred embodiment, such magnetic damping means comprises an electrically-conductive non-magnetic tube which encompasses the passage therein and magnetically interacts with the sensing mass. Specifically, the displacement of the sensing mass within the passage induces a plurality of longitudinally-discrete electric currents in the tube which flow substantially circumferentially therein and which vary with the rate of such sensing mass displacement relative thereto and the distance of the sensing mass therefrom. The electric current induced in each affected longitudinal portion of the tube in turn generates a magnetic field which interacts with the sensing mass to retard the displacement thereof.

The instant invention also features switchable magnetic biasing means for displacing the sensing mass to the second position within the passage without regard to acceleration of the housing, such as an electrical coil proximate with the first end of the passage and switchable means for delivering a direct current through the coil. And, by reversing the direction of current flow through the coil, the threshold magnetic bias may be increased to any desired value without adversely affecting the responsiveness of the sensor.

It is noted that the magnetic bias on the sensing mass resulting from its magnetic interaction with the washer is sufficient to return it to the first position within the passage from any other position therein short of the second position upon a reduction in the acceleration input to the housing. As noted hereinabove, the stop moves longitudinally of the passage in response to changes in the operating temperature of the sensor. More specifically, in the preferred embodiment, the temperature-responsive stop comprises a coil spring formed of a bimetallic material. The coil spring lengthens and, hence, the stop moves longitudinally of the passage towards the switch means, with decreasing temperature, resulting in an increase in the minimum separational distance between the sensing mass and the washer, and a decrease in the stroke of the passage. When combined with the overall increase in the flux generated by the magnets of the sensing mass at such lower temperatures, and the concurrent lowering of the resistance to current flow in the damping tube and the resultant increase in magnetic damping force, the net result is that a substantially similar acceleration input is required to displace the sensing mass to the second position within the passage notwithstanding the decrease in sensor operating temperature. Similarly, where the sensor experiences an increase in temperature, the coil spring shortens, thereby decreasing the minimal separation distance between the sensing mass and the washer, and increasing the stroke of the passage. Again, when combined with the overall decrease in the flux generated by the magnets of the sensing mass at such higher temperatures, and the concurrent heightening of the resistance to current flow in the damping tube and the resultant decrease in magnetic damping force, the net result is that a substantially similar acceleration input is required to displace the sensing mass thereof to the second position within the passage.

DETAILED DESCRIPTION OF THE PREFERRED EMBODIMENT OF THE INVENTION

Figure 1:
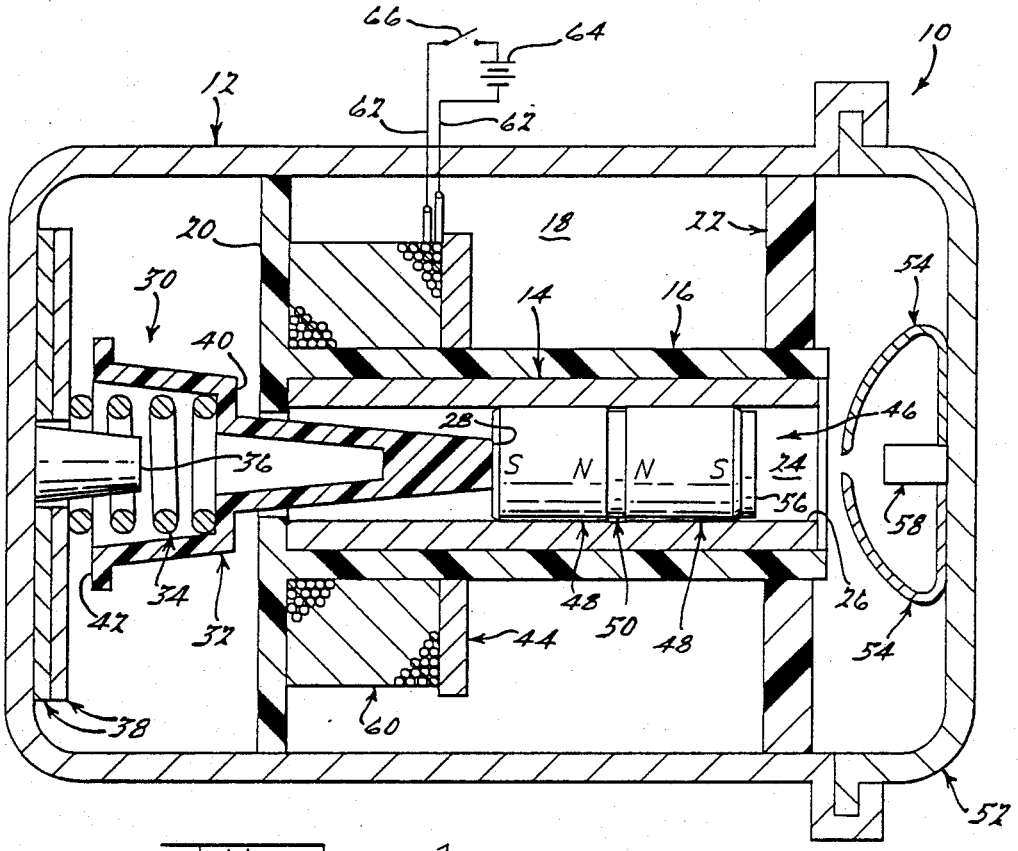
FIG. 1 is a longitudinal view in cross-section of a vehicle accelerometer constructed in accordance with the instant invention showing the magnetic sensing mass thereof in its first position within the passage against the stop and a battery switchably connected across the coil thereof.

A vehicle accelerometer 10 constructed in accordance with the instant invention is illustrated in FIG. 1. An iron or steel housing 12 houses a tube 14 formed of an electrically-conductive non-magnetic material such as copper which is supported with respect thereto as by a encapsulating sleeve 16. The sleeve 16 is preferably formed of an electrically-insulative material such as plastic, and the tube 14 is preferably secured therein as by press-fitting or through the use of an adhesive. Preferably, an annular space 18 is provided between the outer surface of the sleeve 16 and the housing 12 as through the use of a radial flange 20 on one end of the sleeve 16, for purposes to be described hereinbelow. A second radial spacer 22 supports the other end of the sleeve 16 relative to the housing 12, whereby additional support is provided therefor.

Figure 2:
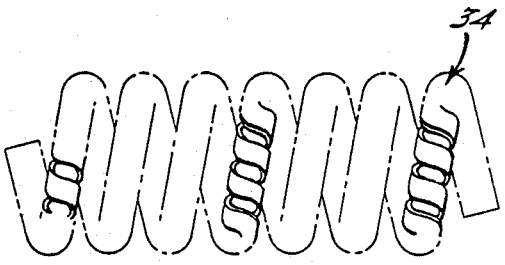
FIG. 2 is an elevational view of the double helical, temperature-responsive coil spring employed by the instant sensor.
Figure 3:
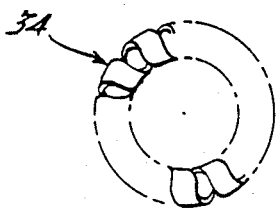
FIG. 3 is an end view of the coil spring shown in FIG. 2.

A right circular cylindrical passage 24 is thus defined within the housing 12 by the inner surface 26 of the copper tube 14. The first end 28 of the passage 24 is in turn defined by a stop assembly 30 comprising an insulator 32 and a temperature-responsive element such as a coil spring 34 formed of at least two materials having disparate coefficients of expansion such as a bimetallic strip wound to form a double helix, as shown in greater detail in FIGS. 2 and 3. An example of a suitable material for the coil spring 34 is the thermostat metal sold by Texas Instruments Incorporated of Sherman, Tex., under the designation "TRUFLEX M7". The coil spring 34 is maintained in alignment with the longitudinal axis of the tube 14 by a projection 36 of the housing 12 and is adjusted longitudinally thereof as through the use of annular shims 38. The insulator 32 is preferably of cylindrical or frustoconical shape so as to ensure its continuing concentricity with the tube 14.

The nominal longitudinal position of the stop 30 within the passage 24, i.e., its position therein at the sensor's nominal operating temperature, is initially set by adjusting the number of shims 38 disposed between the coil spring 34 and the housing 12. The stop 30 is displaced with decreasing temperature to the right as shown in FIG. 1, as limited as by the engagement of a radial shoulder 40 on the insulator 32 with the plastic sleeve 16. The stop 30 is displaced with increasing temperature to the left in FIG. 1, as limited by the engagement of the end 42 of the insulator 32 with the shims 38. Within these limits, however, the stop 30 is free to move longitudinally of the passage 24 in response to changes in the operating temperature of the sensor, whereby the response of the instant accelerometer 10 is adjusted for temperature effects thereon, as discussed hereinbelow.

A magnetically-permeable element such as an iron or steel washer 44 is secured proximate with the first end 28 of the passage 24 as by press-fitting the washer 44 about the plastic sleeve 16. It is noted that, in the preferred embodiment, the washer 44 is placed in proximity with, but electrically isolated from, the copper tube 14. More specifically, the washer 44 is positioned so that a magnetic sensing mass 46 situated within the passage 24 will magnetically interact therewith so as to maintain the sensing mass 46 in a first position in the passage 24 against the stop 30 throughout the operating range of the sensor, in the absence of an acceleration input thereto.

The precise configuration of the washer 44, i.e., the thickness, and the inner and outer diameters thereof, is adjusted so as to obtain the desired threshold magnetic bias when the sensing mass 46 is at the nominal "rest" position in the passage 24. Significantly, the movement of the stop 30 within the passage 24 in response to temperature adjusts the minimum separational distance between the washer 44 and the sensing mass 46 so as to offset the effects of temperature on the magnetic flux generated by the sensing mass 46, whereby the threshold magnetic bias on the sensing mass 46 remains nearly constant throughout the operating temperature range of the sensor 10.

The sensing mass 46 itself comprises a pair of substantially cylindrical magnets 48 formed, for example, of a powdered material comprising neodymium, iron and boron and are magnetized so as to place the magnetic poles thereof at their longitudinal ends, respectively. The sensing mass 46 further comprises a spacer 50 formed of a magnetically-permeable material such as iron. Specifically, the magnets 48 are secured to opposite sides of the spacer 50, respectively, so as to place a pair of like magnetic poles thereof in opposition. For example, FIG. 1 shows the magnets 48 of the sensing mass 46 having opposed "north" poles. The spacer 50 is necessary to convey magnetic lines of force from the interior faces of the "bucking" magnets 50 to the surrounding copper tube 14. Thus, the thickness of the spacer 50 is preferably chosen so as to prevent the magnetic saturation of the material thereof while maximizing the magnetic flux generated by the sensing mass 46. It is noted that an increase of forty percent has been observed in the magnetic field generated by the dual-magnet sensing mass 46 of the instant accelerometer over the prior art single-magnet sensing mass formed of the same magnetic material and having the same external dimensions.

The diameter of the spacer 50 is less than that of the magnets 48 so as to ensure that the spacer does not protrude beyond the envelope thereof, as such a protruding edge would likely result in deleterious contact between the spacer 50 and the tube 14, e.g., increased wear of the copper tube 14 and decreased sensor responsiveness due to the increase in the frictional resistance to displacement of the sensing mass 46 within the passage 24. Additionally, it is significant to note that the magnets 48 and the spacer 50 of the sensing mass are permitted to make electrical contact with the copper tube 14—the electrical resistance of the magnets and of the spacer are considerably higher than the resistance of the copper tube 14 and, therefor, the resultant magnetic damping force is not significantly affected by such contact.

Referring again to FIG. 1, the second end of the passage 24 is defined by the cap 52 comprising the other end of the housing 12. A pair of electrical contacts 54 are mounted on the cap 52 so as to project across the open end of the tube 14. The contacts 54 are preferably formed of beryllium-copper which has been gold-plated for improved electrical contact and greater corrosion resistance. The housing 12 is preferably sealed upon attachment of the cap 52 thereto during final assembly as by interlocking peripheral flanges thereon, respectively, in order to prevent the infiltration thereinto of moisture and other contaminants which might adversely affect the operation of the instant accelerometer 10. However, it is significant that the hermetic integrity of the seal thus formed between the cap 52 and the housing 12 is not critical to the continued operation of the sensor.

In operation, the sensing mass 46 is magnetically biased towards the washer 44 so as to remain in the first position within the passage 24 against the stop 30 until the threshold magnetic bias therebetween is exceeded by an acceleration input to the housing 12, whereupon the sensing mass 46 is displaced in response to such acceleration towards a second position within the passage 24 proximate with the second end thereof. Specifically, the second position of the sensing mass 46 within the passage 24 is the position therein which results in the engagement of an electrically-conductive surface 56 of the sensing mass 46 with the contacts 54, whereby the contacts 54 are electrically bridged by the sensing mass 46. The electrically-conductive surface 56 of the sensing mass 46 may comprise a copper element secured thereto which is in turn gold-plated for improved electrical contact and greater corrosion resistance. A second stop 58 prevents the escape of the sensing mass 46 from the tube 14 and prevents deleterious over-flexing of the contacts 54 when the sensor is subjected to an extreme acceleration, or during a test of the sensor in the manner described hereinbelow.

The magnetic bias on the sensing mass 46, i.e., the magnetic attraction between the sensing mass 46 and the washer 44, is sufficient to return the sensing mass 46 to its first position against the stop 30 from any other position within the passage 24 short of the second position upon a reduction in the accelerating input to the housing 12. The inner surface 26 of the tube 14, or the radially-outermost portion of the sensing mass 46, is preferably teflon coated to reduce the sliding friction therebetween.

In as much as the stop 30 and, hence, the first position of the sensing mass 46 within the passage 24, moves longitudinally of the passage 24 in response to changes in the temperature, the "stroke" of the passage 24, i.e., the distance that the sensing mass 46 must travel to be displaced from its first position within the passage 24 against the stop 30 to the second position therein automatically adjusts so as to compensate for the effects of temperature on the magnetic properties of the sensing mass 46 and the electrical resistance of the tube 14, as described more fully below.

The tube 14 of the accelerometer 10 provides magnetic damping for the sensing mass 46 which varies in proportion to the rate of such displacement of the sensing mass 46. More specifically, the tube 14 provides a magnetic field which opposes such displacement of the sensing mass 46 through the inducement therein of an electric current by the magnetic field of the sensing mass 46. It is noted that the damping tube 14 may encompass another element (not shown) defining the passage 24 or may itself define the passage 24, as shown in FIG. 1.

It is also noted that the tube 14 may be replaced by a multiplicity of electrically-conductive longitudinally-spaced rings (not shown) which are electrically isolated from one another by insulative spacers (also not shown) so as to permit the inducement therein of direct currents of different amplitude, flowing in opposite directions, upon displacement of the sensing mass 46 relative thereto. In the preferred embodiment, however, the magnetic pole pitch of the sensing mass 46 is such that, as a practical matter, only a single encompassing tube 14 may be employed. It is believed that the magnetic field of the sensing mass 46 induces substantially circumferential flow of current in that portion of the tube 14 affected thereby. As a result, the resulting counterflowing electrical currents proximate the magnetic poles of the sensing mass 46 do not flow longitudinally of the tube 14 and, hence, do not cancel each other out.

Variations in the magnetic damping field which result from changes in the resistance of the tube 14 and the magnetic flux density generated by the sensing mass 46 due to changes in the temperature thereof are accommodated through the adjustment of the stroke of the passage 24 as described hereinabove. The accelerometer 10 thus continues to accurately integrate the acceleration input to the housing 12 notwithstanding changes in the operating temperature thereof.

The electromagnetic damping generated by the interaction between the tube 14 and the sensing mass 46 obviates the need for extreme manufacturing tolerances with respect to the gap between the sensing mass 46 and the inner surface 26 of the tube 14. For example, with the instant sensor, the gap may be on the order of about ten thousandths of an inch, in contrast with a gap of perhaps only twenty microns which is typically required in prior art gas-damped sensors. Moreover, since the magnetic damping employed by the instant accelerometer 10 is unaffected by a breach of the seal formed between the housing 12 and the cap 52, there is no inherent failure mode as in such prior art gas-damped sensors.

An electrically-conductive wire 60 is wound around a coil form comprising the outer surface of the plastic sleeve 16, the sleeve's radial flange 20, and the washer 44. Thus, the coil 60 encompasses the tube 14 proximate with the first position of the sensing mass 46 therein, and the housing 12 provides an additional flux path for the magnetic flux generated upon the energizing of the coil 60. A pair of lead wires 62 extends through the housing 12 to facilitate the connection of the coil 60 with a battery 64 via a switch 66, as illustrated schematically in FIG. 1.

The operability of the accelerometer 10 is tested by delivering a unidirectional current pulse through- the coil 60. The resulting magnetic field magnetizes the washer 44, which in turn repels the sensing mass 46 to the second position within the passage 24. For example, for the magnetic-pole orientations of the sensing mass 46 illustrated in FIG. 1, the current would be directed through the coil 60 so as to transform the washer into the "south" pole of an electromagnet, whereby the sensing mass would be instantaneously repelled from its first position, or any position between its first position and the second position, to the second position within the passage 24. Upon reaching the second position, the electrically conductive surface 56 of the sensing mass 46 bridges the contacts 54, whereby full sensor function is confirmed.

It is significant that, in contrast with known testable accelerometers, the instant invention obviates the need for overriding the nominal magnetic bias on the sensing mass 46 resulting from the magnetic attraction of the sensing mass 46 to the washer 44 since there is only the repelling force upon energizing the coil 60. A significant benefit is the reduced risk of demagnetizing the magnets 48 of the sensing mass 46 when the coil 60 is selectively energized.

The direction of current flow through the coil 60 may be reversed to increase the magnetic force biasing the sensing mass against the stop 30, whereby the accelerometer may be recalibrated to indicate a higher acceleration threshold. For example, where the instant accelerometer 10 is employed as a low-threshold "arming" sensor for a second high-threshold sensor, the threshold of the former may be increased in the event of a failure of the latter, whereby system reliability is substantially improved.

It is noted that the sensor housing 12 and cap 52 are formed of iron or steel in order to isolate the sensing mass 46 from external electromagnetic fields and materials. And, while the housing 12 may magnetically interact with the sensing mass 46 so as to force it into engagement with the passage surface 26, such engagement may nonetheless be preferable to the unpredictable effects on sensor response due to such external magnetic fields and materials. Moreover, the housing 12 may be asymmetrically positioned about the tube 14 so that the magnetic interaction between the housing 12 and the sensing mass 46 therein tends to counter the force of gravity on the latter, whereby the engagement between the sensing mass 46 and inner surface 26 of the tube 14 due to gravity is also minimized.

While the preferred embodiment of the invention has been disclosed, it should be appreciated that the invention is susceptible of modification without departing from the spirit of the invention or the scope of the subjoined claims.

We claim:

1. An accelerometer comprising a housing having a passage extending therein:

stop means defining a first end of the passage, said stop means moving longitudinally of the passage in response to temperature;

a magnetically-permeable element secured to said housing proximate with the passage;

a magnetic sensing mass in the passage, said sensing mass being magnetically biased towards said magnetically-permeable element so as to remain in a first position against the stop means until said magnetic bias is overcome by acceleration of said housing, whereupon said sensing mass is displaced in response to such acceleration from said first position towards a second position in the passage, said magnetic bias being sufficient to return said sensing mass to said first position from any other position in the passage short of said second position; and switch means operable by said sensing mass when said sensing mass is displaced to said second position.

2. The accelerometer of claim 1 wherein said stop means comprises a coil spring formed of a bimetallic material.

3. The accelerometer of claim 1 wherein said stop means moves longitudinally of the passage towards said switch means with decreasing temperature.

4. The accelerometer of claim 1 wherein said switch means comprises a pair of electrical contacts engageable with an electrically-conductive surface of said sensing mass upon displacement of said sensing mass to said second position, whereby said contacts are electrically bridged by the electrically-conductive surface of said sensing mass.

5. The accelerometer of claim 1 including magnetic damping means for retarding the displacement of said sensing mass in the passage.

6. The accelerometer of claim 5 wherein said magnetic damping means comprises an electrically conductive non-magnetic tube encompassing a longitudinal section of the passage, the displacement of said sensing mass in the passage inducing an electric current flowing substantially circumferentially in said tube, said electric current in said tube generating a magnetic field opposing such displacement of said sensing mass.

7. The accelerometer of claim 1 including switchable means for reversibly magnetizing said magnetically-permeable element to repel said sensing mass to said second position without regard to acceleration of said housing.

8. The accelerometer of claim 7 wherein said switchable means for reversibly magnetizing said magnetically-permeable element comprises an electrical coil proximate with said magnetically-permeable element and switchable means for delivering a direct current through said coil.

9. The accelerometer of claim 1 including switchable means for reversibly magnetizing said magnetically-permeable element to increase the magnetic bias of said sensing mass against said stop means, whereby the acceleration needed to displace said sensing mass to said second position is increased.

10. The accelerometer of claim 9 wherein said switchable means for reversibly magnetizing said magnetically-permeable element comprises an electrical coil proximate with said magnetically-permeable element and switchable means for delivering a direct current through said coil.

11. The accelerometer of claim 1 including a magnetic shroud encompassing said passage.

12. The accelerometer of claim 11 wherein said magnetic shroud is tubular and the longitudinal axis of said shroud is parallel with the longitudinal axis of the passage.

13. An accelerometer comprising a tube;

stop means defining an end of said tube, said stop means moving longitudinally of said tube in response to temperature:

a magnetically-permeable element proximate with said tube;

a magnetic sensing mass in said tube, said sensing mass being magnetically biased towards said magnetically-permeable element so as to remain in a first position against said stop means until said magnetic bias is overcome by acceleration of said tube, whereupon said sensing mass is displaced in response to such acceleration from said first position towards a second position in said tube, said magnetic bias being sufficient to return said sensing mass to said first position from any other position in said tube short of said second position; and switch means operable by said sensing mass when said sensing mass is displaced to said second position.

14. The accelerometer of claim 13 wherein said tube is formed of an electrically-conductive nonmagnetic material, and said magnetically-permeable element is electrically isolated from said tube.

15. The accelerometer of claim 13 wherein said stop means comprises a coil spring formed of at least two of materials having disparate coefficients of expansion.

16. The accelerometer of claim 13 including an electrical coil proximate with said magnetically-permeable element and switchable means for delivering a direct current through said coil, whereby said magnetically-permeable element is magnetized upon such delivery of said current to said coil.

* * * * *